United States Patent [19]

Polite, Jr.

[11] 4,328,910

[45] May 11, 1982

[54] DEVICE FOR CUTTING CAULKING NOZZLES

[76] Inventor: Richard H. Polite, Jr., 5024 E. 2nd St., Tulsa, Okla. 74112

[21] Appl. No.: 146,514

[22] Filed: May 5, 1980

[51] Int. Cl.[3] ..... B67B 7/24

[52] U.S. Cl. ..... 222/81; 222/541; 222/386

[58] Field of Search ..... 222/81, 82, 541, 386, 222/388, 390, 391, 392, 389, 23; 30/2, 92, 96, 289; 206/601

[56] References Cited

U.S. PATENT DOCUMENTS

| | | | |
|---|---|---|---|
| 1,075,439 | 10/1913 | Quinlin | 30/92 |
| 2,356,165 | 8/1944 | King | 30/289 |
| 2,508,696 | 5/1950 | Thompson | 30/96 X |
| 2,615,239 | 10/1952 | Allan et al. | 206/601 X |
| 2,644,608 | 7/1953 | Lee | 222/81 X |
| 4,146,152 | 3/1979 | Ogawa | 222/81 |

*Primary Examiner*—Allen N. Knowles
*Attorney, Agent, or Firm*—Head & Johnson

[57] ABSTRACT

A device for use in trimming the tip off the resilient nozzle of a caulking tube, the device being formed of a tubular body of internal dimensions to telescopically receive a caulking tube nozzle, the body having a slit therein in a plane intersecting the body tubular axis, the slit being of a width to receive a knife blade so that after the trimming device is placed on the nozzle of a caulking tube the user may cut off the nozzle tip by guiding a knife blade in the slit to thereby achieve a consistent, uniform angle of the trimmed nozzle.

5 Claims, 4 Drawing Figures

DEVICE FOR CUTTING CAULKING NOZZLES

BACKGROUND OF THE INVENTION

1. Field of the Invention

This invention relates to a device for use in trimming the plastic nozzles on caulking tubes in a manner such that the trimmed end through which the caulking is discharged will have a uniform diameter and angle.

2. Description of the Prior Art

Most of caulking applications at the present time are done utilizing caulking tubes, which are means of prepackaging caulking material. A caulking tube consists of a cylindrical barrel of disposable material, usually paper. At one end of the barrel a flange is provided which receives a tubular tapered nozzle of resilient material, usually of plastic. Between the end of the barrel and the nozzle a frangible seal is provided and the nozzle is closed at its outer end. At the other end of the barrel there is a slidable piston. The contents of the caulking tube are used by inserting it into a caulking gun so that the nozzle extends from one end of the gun. The caulking gun includes means for forcing the piston forward to expel the contents out the nozzle. A trigger mechanism is employed with the caulking gun which actuates a ratchet mechanism to advance a plunger engaging the piston to force the caulking material out the nozzle end.

When the user is ready to employ a tube of caulking, he must cut off the closed end of the nozzle. The present commonly practiced means of doing this is for the user to carry with him a pocket knife and the user merely cuts off the nozzle end using the knife. After the nozzle end is cut off the frangible diaphragm must be punctured by extending a plunger such as a long nail or the like, through the exposed end of the nozzle. The caulking tube is then ready to use. The operation of cutting off the nozzle and puncturing the diaphragm can be done before or after the caulking tube is placed in the caulking gun.

For uniformity of application of caulking material, it is desirable that the tubular nozzle be cut at a consistent and uniform angle and at a selected position on the tapered tubular nozzle so that the exposed open end of the nozzle is of a uniform internal diameter. In this way, the bead of caulking ejected from the nozzle is uniform. An object of this invention is to provide an inexpensive and easily utilized device for use in cutting the end off a caulking tube nozzle to provide a uniform slope and internal diameter of the severed nozzle.

Others have recognized that a means must be provided for cutting off the tapered end of a caulking tube nozzle, such as in U.S. Pat. No. 3,105,614, entitled "CAULKING GUN WITH TRIMMING ATTACHMENT," issued Oct. 1, 1963. This patent shows a caulking gun of the type to which the present invention is applicable and shows a means of cutting off the end of a caulking tube nozzle, but the limitation of this device is that it cuts the nozzle only at an angle of 90° relative to the tubular axis of the nozzle. Most users of caulking tubes prefer that the nozzle tip be cut off at an angle to the tubular axis of substantially less than 90°. An acute angled cut of the nozzle facilitates the application of caulking material and more uniform results of caulking application can be obtained.

It is therefore an object of this invention to provide a device for use in trimming the tip off the nozzle of a caulking tube.

More particularly, an object of this invention is to provide a simple, inexpensive device which may be inserted on the tapered tubular nozzle of a caulking tube to provide a guide for trimming the tip off the nozzle at a uniform angle and providing a uniform internal diameter of the nozzle after it is trimmed.

Still more particularly, an object is to provide a device for use in trimming the tip off the nozzle of a caulking tube including an integral plunger for severing the caulking tube diaphragm seal after the nozzle is trimmed and including means with the caulking gun of conveniently attaching the trimming device to the gun.

SUMMARY OF THE INVENTION

A device is provided for use with a caulking tube of the type having an integral tapered tubular plastic nozzle. The device is tubular with the internal dimensions to receive the tapered nozzle. The tubular body of the device has a slit therein extending substantially through the tubular device, the slit being of width to receive the blade of a knife. The plane of the slit is at a selected angle of intersection with the tubular axis of the body and thereby of the nozzle when the body is placed on a nozzle; the angle being between 30° and 90° relative to the tubular axis and preferably between 40° and 75°. The device is used by sliding it onto a caulking tube nozzle and the user forcing the blade of a knife through the caulking tube nozzle guided by the slit in the body to thereby sever the nozzle at the preselected angle of the slit and forming an opening in the nozzle tube of a preselected internal diameter.

As an alternate arrangement, the device includes a plunger rod affixed to the exterior of the body in a plane of the tubular axis, the rod being secured to the body on the side opposite the slit and extending from one end of the body a sufficient distance so that after the tip end has been severed from a caulking tube nozzle the plunger rod may be extended within the nozzle to sever the diaphragm seal within the caulking tube. In still another arrangement, a caulking gun is provided having a tubular element affixed to the body which slidably receives the plunger rod of the trimming device so as to provide a means of retaining it with a caulking gun for convenience of use.

DETAILED DESCRIPTION

Figure 3:
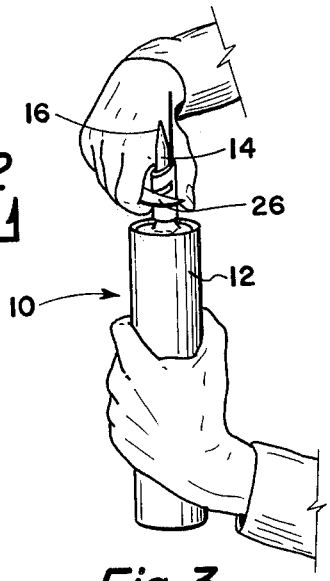
FIG. 3 is an illustration of the means of utilizing the device for trimming the end of the nozzle of a caulking tube.

Referring first to FIG. 3, a typical caulking tube is generally indicated by the numberal 10 and consists of a disposable barrel 12, usually formed of paper and which contains a dispensable viscous material. While the invention will be described as it is utilized for trimming the nozzles of tube 10 as employed for dispensing caulking, it is understood that the word "caulking" is used in a broad sense. Tubes 10 are frequently utilized to discharge many other kinds of viscous liquid material such as adhesive. The tube 10 includes an integral tubular tapered nozzle 14 formed of resilient material, usually plastic. The outer end of nozzle 14 has a closed tip 16 to retain the contents of barrel 12 and this closed tip must be cut off the nozzle in order for the tube to be used. This invention is directed towards a device for providing means for use in cutting off nozzle tip end 16 in a uniform manner.

Figure 1:
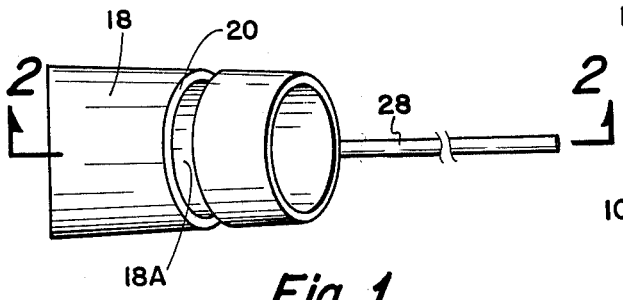
FIG. 1 is an elevational view of a preferred embodiment of the caulking tube nozzle trimming device of this invention.
Figure 2:
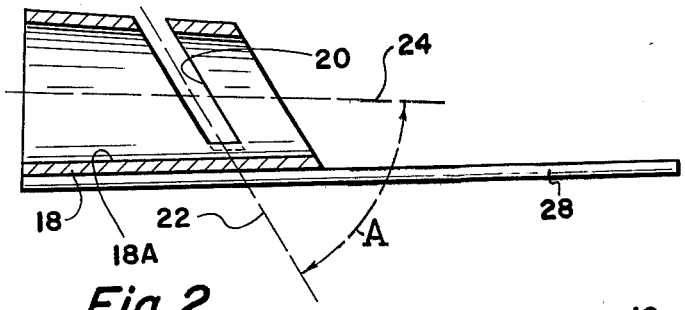
FIG. 2 is a cross-sectional view taken along the line 2—2 of FIG. 1.

Referring to FIGS. 1 and 2 the device of the invention is best illustrated. It is in the form of a tubular body 18 of rigid material such as metal or hard plastic. The internal diameter of tubular body 18 is such as to slidably receive, in a telescopic manner, the tubular nozzle 14 of a caulking tube. In the preferred arrangement the internal surface 18A of the body is tapered to conform to the taper of tubular nozzle 14. Whether straight, cylindrical, or tapered, the internal dimensions of the body 18 are such that when positioned on a nozzle 18 the body slides a preselected distance past the tip end 16 or, more precisely, to a distance wherein the body encompasses a portion of the nozzle 14 of a preselected diameter.

Formed in body 18 is a planar slit 20 which extends substantially all the way through the body. The plane of slit 20 identified by the numeral 22 is at a selected angle A relative to the body tubular axis identified by the numeral 24. The angle A is between 90° and 30° with the preferred range being between 60° and 45°.

The width of slot 20 is dimensioned to slidably receive the blade of a knife. As illustrated in FIG. 3, the device is used by sliding it on the caulking tube nozzle 14 until it snugly receives the nozzle. Thereafter the user urges a knife blade 26 into slot 20 to sever the caulking tube nozzle. This achieves two important results. First, and of great importance, it causes the user to cut the caulking tube nozzle 14 at a uniform and preselected angle. Second, it causes the user to cut the caulking tube nozzle 14 so that the internal diameter of the severed end will be uniform. Thus, an opening is provided for the discharge of contents of the caulking tube 10 which is of a uniform diameter and slope. This result is not achievable wherein the user merely uses a knife to cut the end since controlling the position of the cut so as to select the diameter, and controlling the slope of the cut, can only be a matter of estimate without a means of guiding the blade of the knife employed by the user.

Caulking tubes universally employ an internal diaphragm (not shown in the drawings) between the end of the caulking tube barrel 12 and nozzle 14. After the nozzle tip end is cut off it is necessary to puncture this diaphragm or seal so that the contents of the caulking tube may be discharged out the nozzle end. For this purpose a plunger rod 28 is affixed to the outside of tubular body 18 in the plane of the tubular axis 24. The plunger rod is fixed to the body 18 at a point opposite the slot 20 and extends from one end of the body a sufficient distance to reach through the open nozzle of the caulking tube to penetrate the diaphragm seal.

Figure 4:
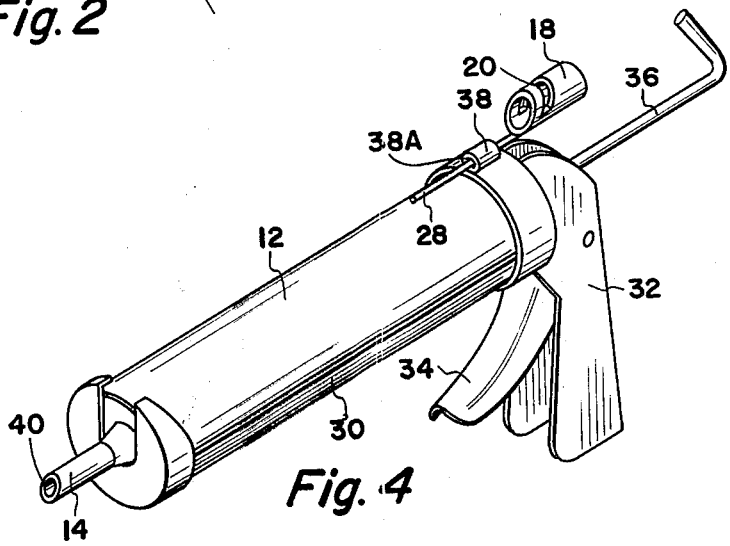
FIG. 4 is an isometric view of a caulking gun having a caulking tube therein, the nozzle of the tube having been severed utilizing the device, and showing means of retaining the device with a caulking gun for convenience of the user.

FIG. 4 shows the device for trimming the nozzle of a caulking tube supported to a caulking gun so that the trimming device will be readily available for use when a new caulking tube is employed. The caulking gun of FIG. 4 is the standard type including a body 30 which receives a caulking tube barrel in a manner so that the nozzle 14 extends from the body forward end. The other end of the body 30 includes a handle 32 supporting a trigger mechanism 34 which, when reciprocally actuated, advances by a ratchet action, a rod 36 which extends inwardly to engage the piston (not shown) which is a part of the standard caulking tube. The details of the caulking gun, including elements 30-36, are not a part of this invention since they are representative of known types of caulking guns. The addition supplied by this invention is a short, tubular keeper 38 affixed to the caulking gun body 30. The keeper 38 has an internal opening 38A which snugly and slidably receives the plunger rod 28 of the trimming device. In this manner the trimming device can be removably attached to the caulking gun and always be readily available for convenient use when the user needs to trim a caulking tube nozzle.

FIG. 4 shows the caulking tube nozzle 14 having been trimmed by the use of the device as shown in FIGS. 1 and 2. The trimmed nozzle 14 has a uniform angle and a uniform internal diameter 40. Thus by the use of this device these two important characteristics of a trimmed nozzle are uniformly achieved so that the applicator is always working with a uniform discharge of caulking material. The device is inexpensive and readily employed and by the arrangement of FIG. 4 can be kept conveniently accessible to the user of the caulking gun.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the claims, including the full range of equivalency to which each element thereof is entitled.

What is claimed is:

1. For use with a caulking tube having an integral tapered tubular nozzle of resilient material extending therefrom, a device for use in trimming the tip off the nozzle comprising:

a tubular body of internal dimension to telescopically receive the tapered tubular nozzle of a caulking tube and thereby slidable onto a caulking tube nozzle a preselected distance past the nozzle tip, the body having a slit therein in a plane through the body tubular wall past the body tubular axis, the slit being of a width to slidably receive a knife blade whereby a blade may be guided to cut the nozzle at the angle of the slit.

2. A device for use in trimming the tip off the nozzle of a caulking tube according to claim 1 wherein the tubular body is internally tapered to conform to the external taper of a caulking tube nozzle.

3. A device for use in trimming the tip off the nozzle of a caulking tube according to claim 1 wherein the angle of intersection of the plane of said slit with the body tubular axis is between 30° and 90°.

4. A device for use in trimming the tip off the nozzle of a caulking tube according to claim 1 including:

a plunger rod affixed to the exterior surface of said body in a plane of the body tubular axis and on the side thereof opposite said slit, the plunger rod extending beyond one end of the body and providing means of puncturing the seal in a caulking tube.

5. A caulking gun for dispensing the contents of a caulking tube formed of a dispensable barrel, the barrel having a tapered resilient tubular nozzle extending from one end and a piston closing the other end and a frangible seal at the end of the barrel communicating with the nozzle, including means for use in trimming the tip off the nozzle comprising:

a caulking gun body having means for receiving a caulking tube therein, whereby the caulking tube nozzle extends from one end thereof and including means of selectably advancing the caulking tube piston to expel the tube contents through the nozzle;

a device for trimming the tip off the caulking tube nozzle formed of a tubular body of internal dimension to telescopically receive the tapered tubular nozzle of a caulking tube and thereby slidably onto a caulking tube nozzle a preselected distance past the nozzle tip, the body having a slit therein in a plane through the body tubular wall past the body tubular axis, the slit being of a width to slidably receive a knife blade whereby a blade may be guided to cut the nozzle at the angle of the slit;

a plunger rod affixed to the exterior surface of said body in a plane of the body tubular axis and on the side thereof opposite said slit, the plunger rod extending beyond the end of the body and providing means of puncturing the seal in a caulking tube by extending the plunger rod with the caulking tube nozzle after the tip has been cut off; and a short tubular keeper affixed to said caulking gun body of internal dimensions to slidably and snugly receive said plunger rod whereby said trimming device may be removably attached to said caulking gun.

* * * * *